US008510889B2

(12) United States Patent
Hui et al.

(10) Patent No.: US 8,510,889 B2
(45) Date of Patent: Aug. 20, 2013

(54) AUTOMATED POOL CLEANING VEHICLE WITH MIDDLE ROLLER

(75) Inventors: Wing-tak Hui, Hong Kong (HK); Wing-kin Hui, Hong Kong (HK)

(73) Assignee: Wing-kin Hui, Hong Kong (HK)

( * ) Notice: Subject to any disclaimer, the term of this patent is extended or adjusted under 35 U.S.C. 154(b) by 386 days.

(21) Appl. No.: 12/914,041

(22) Filed: Oct. 28, 2010

(65) Prior Publication Data

US 2012/0102664 A1 May 3, 2012

(51) Int. Cl.
*E04H 4/16* (2006.01)

(52) U.S. Cl.
USPC ..... 15/1.7

(58) Field of Classification Search
USPC ..... 15/1.7
See application file for complete search history.

(56) References Cited

U.S. PATENT DOCUMENTS 4,768,532 A * 9/1988 Johnson ..... 134/111
5,197,158 A * 3/1993 Moini ..... 15/1.7

* cited by examiner

*Primary Examiner* — Randall Chin
(74) *Attorney, Agent, or Firm* — Douglas Chaikin; Peninsula IP Group

(57) ABSTRACT

Disclosed herein is an automated pool cleaning vehicle (PCV) having a middle roller. The PCV having a housing. The housing defines an interior. Located within the interior is a pump and a filter bag. The housing also includes a bottom, which is generally curved in a concave manner. The housing further includes a chassis. The pump creates a vacuum for sucking up dirt and debris into the filter bag through intakes in the housing. The housing including first and second pairs of wheels connected to the chassis. Between the front and second wheels is a middle roller, also connected to the chassis. In a first embodiment, the middle roller includes a single roller, which is approximately the same diameter as the wheels of the first and second pairs of wheels. In other embodiments, the wheels of the middle roller are larger or smaller. In yet another embodiment, the middle roller includes a series of wheels.

10 Claims, 4 Drawing Sheets

AUTOMATED POOL CLEANING VEHICLE WITH MIDDLE ROLLER

FIELD OF THE INVENTION

This invention generally relates to the field of automated pool cleaning vehicles (PCV). More particularly, this invention relates to PCV's having special structures for climbing steps and other irregular objects in a pool while thoroughly cleaning the pool surfaces.

BACKGROUND OF THE INVENTION

In order to properly maintain clean pool water, the water itself as well as the pool surfaces must be cleaned and kept clean. It is imperative to keep the pool surfaces free from the build up of dirt and debris. Once dirt and/or debris is allowed to settle in on the pool surface, algae forms. A large enough build-up of such algae can cause the pool pH to become unbalanced as well as unstable. Sometimes drastic efforts caused by "dirty" water result in the entire contents of the pool being drained and starting again. As can be appreciated this is an expensive and time consuming process.

Clearly this scenario is most undesirable. Water is wasted and the entire pool surface must be "dry" cleaned to the point of almost being sterilized. This must be done before re-filling the pool with fresh water. Additionally, it takes several days, if not weeks, before the new pool water can be seasoned and once again ready for safe use.

Dry cleaning and emptying and re-filling the pool are clearly drastic and undesirable steps. And, are taken only when necessary. However, such steps readily justify putting diligent efforts into cleaning and maintaining the pool water and the pool surfaces. Typically, consistent, with those efforts, a pool owner will employ an automated pool cleaning vehicle or PCV.

As shown in FIG. 1 (PRIOR ART), the PCV of the prior art includes a housing 12, having a central opening defining an interior portion. Attached to the housing is a chassis having a first set of wheels 14 and a second set of wheels 16. The wheels define rollers having brushes for stirring up and encouraging dirt and debris to enter intakes in the housing 12. At least one pair of the wheels (rollers) defines drive wheels for moving the PCV around the surface of the pool.

As shown in FIG. 1, the bottom 18 of the housing 12 is flat and straight. Also as shown in FIG. 1, the PCV is attempting to mount steps in a pool. As shown, the angle of the steps and the flat, straight bottom of the PCV cause the PCV to get hung up on the steps. This may lead to the steps or at least portions of the steps not being thoroughly cleaned or even cleaned at all.

In other prior art embodiments, there have been PCV having a curved bottom. However, the curvature must be enough to overcome even steep steps or it is of no use. Additionally, the curvature may causes shrinkage of the interior space of the housing. Interior space is needed to provide room for a filter bag and dirt and debris collected therein. If the space is too small, the filter bag will need to be change quite frequently in order to properly do its job. Alternatively, the curvature could cause the housing to become excessively large.

Applicants have developed a PCV, which overcomes the earlier described deficiencies while providing a PCV, which fits within the conventional size parameters of modern PCV's.

SUMMARY OF THE INVENTION

The structure of the invention is a PCV having specialized structure to climb and clean steps and other irregular surfaces without changing the physical parameters of the modern PCV. The specialized structure includes a middle roller. Additionally, the structure includes a curved bottom. Associated with the middle roller is an intake member for co-operating with a vacuum pump and filter bag.

It is an object of this invention is to provide a PCV, which thoroughly cleans dirt and debris from the pool surfaces, including irregular pool surfaces.

It is another object of this invention to provide a PCV having a middle roller with additional water intakes for thoroughly cleaning dirt and debris from the pool surfaces, including irregular pool surfaces.

In accordance with the objects set forth above and as will be described more fully below, the PCV in accordance with this invention, comprises:

a housing defining an enclosure having an interior, the housing having a bottom and the bottom being concave;

a first and second pair of wheels connected to the housing and adapted to facilitate vehicle movement;

at least one other pair of wheels defining a middle roller, the middle roller connected to the housing between the first and second pair of wheels;

an intake means associated with each pair of wheels for facilitating the sucking up of dirt and debris into the housing through the vacuum created by the pump.

In another exemplary embodiment, the PCV includes a middle roller having series of rollers between the first and second rollers.

In another exemplary embodiment, each of the rollers is approximately the same diameter as the first and second wheels.

It is an advantage of the PCV in accordance with invention to provide specialized structure, which thoroughly cleans the dirt and debris from pool surfaces, including irregular pool surfaces.

BRIEF DESCRIPTION OF THE DRAWING

For a further understanding of the objects and advantages of the present invention, reference should be had to the following detailed description, taken in conjunction with the accompanying drawing, in which like parts are given like reference numerals and wherein.

DETAILED DESCRIPTION OF THE INVENTION

In order to appreciate the invention herein, one must appreciate the need in the art as set forth in the Background. Most importantly, pool surfaces regularly provide irregular surfaces and obstacles for PCV's to negotiate. Surfaces and obstacles such as steps can form the foothold from which dirt and algae form and contaminate pool water. Applicant herein has provided through its structure herein, a device for resolving the long felt need to thoroughly and completely clean pool water and pool surfaces, even when pools regularly present obstacles and irregular surfaces. At the same time, the structure of the invention herein maintains the conventional size and shape of the PCV, while employing specialized structure for greater thoroughness in cleaning irregular pool surfaces, even irregular pool surfaces with obstacles such as stairs and the like. The specialized structure is illustrated by the various exemplary embodiments in accordance with the disclosed invention are described in FIGS. 3-8 and include a middle roller and a curved bottom as well as associated intakes associated with the middle rollers and other drive or non-drive wheels or rollers.

Figure 4:
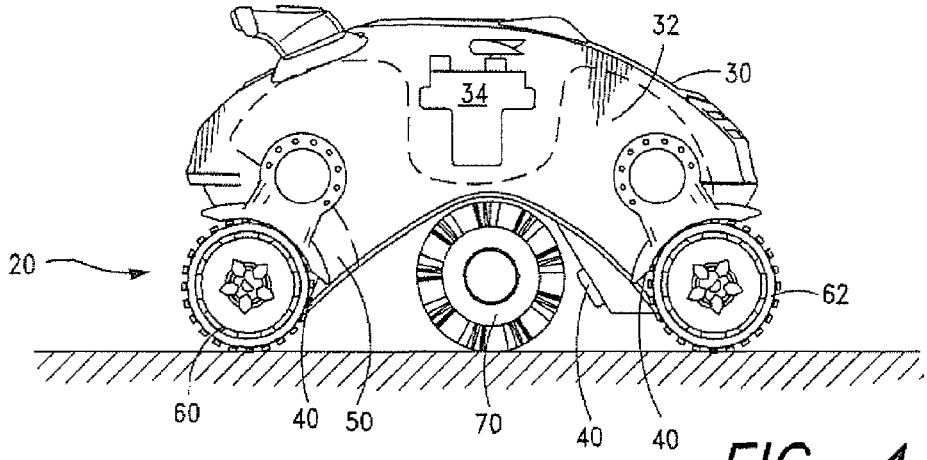
FIGS. 4 & 5 illustrate a second exemplary embodiment of the PCV in accordance with this invention, the second exemplary embodiment including a curved bottom.

With particular reference to FIG. 4, there is shown an exemplary embodiment of the PCV denoted generally by the numeral 20. Illustrated therein is the PCV 20 having a housing 30 with a central opening 32. Within the central opening 32, there is a pump 34. The pump 34 creates a vacuum. The pump 34 is connected to intakes 40. When the pump 34 is active, the vacuum causes dirt and debris to sucked into the housing 30 through the intakes 40.

Although not shown, the intakes 40 are connected to a filter bag, as is well known in the art. The filter bag is removable, generally speaking by opening the top of the housing. Upon removal, the filter bag is emptied and cleaned and readied for its next use. It is then reinserted into the housing reversing the steps, which were used to remove the filter bag.

Clearly it would be advantageous not to remove the filter bag often. However, if the interior of the housing 30 is too small, then it will need to be more frequently opened and cleaned because of the small interior space. As note earlier, when the prior art structure employs such a curved bottom, the interior space of the prior art housing is severely limited. This will most likely lead to frequent filter bag changes.

Figure 1:
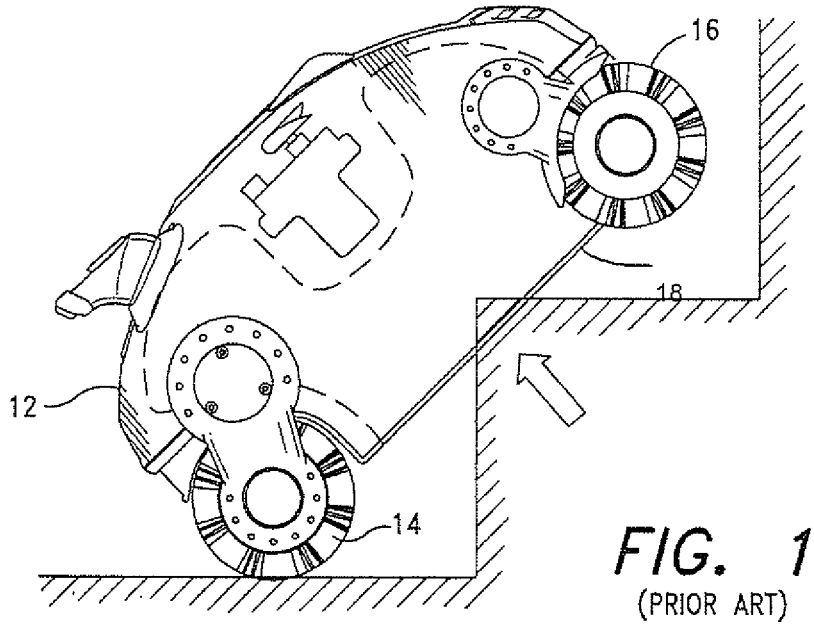
FIG. 1 (PRIOR ART)
FIGS. 1 & 2 illustrate two exemplary embodiments of PCV in the Prior Art, which have been discussed above.
Figure 2:
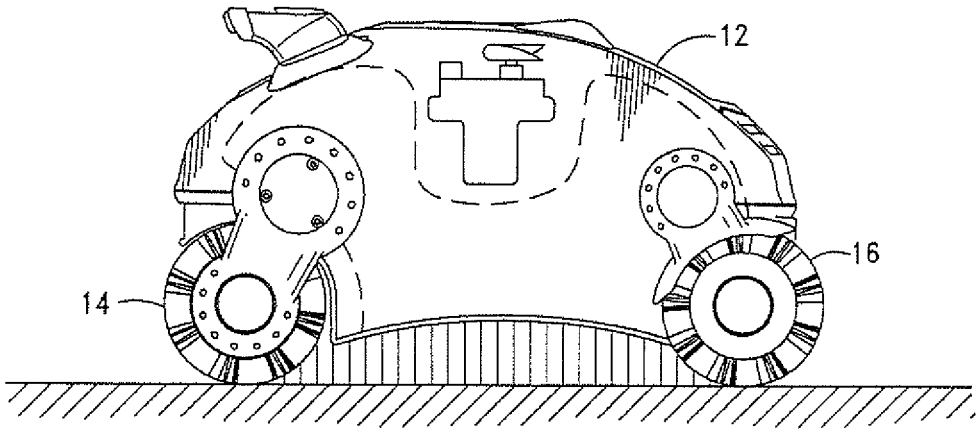
FIG. 2 (PRIOR ART)
Figure 5:
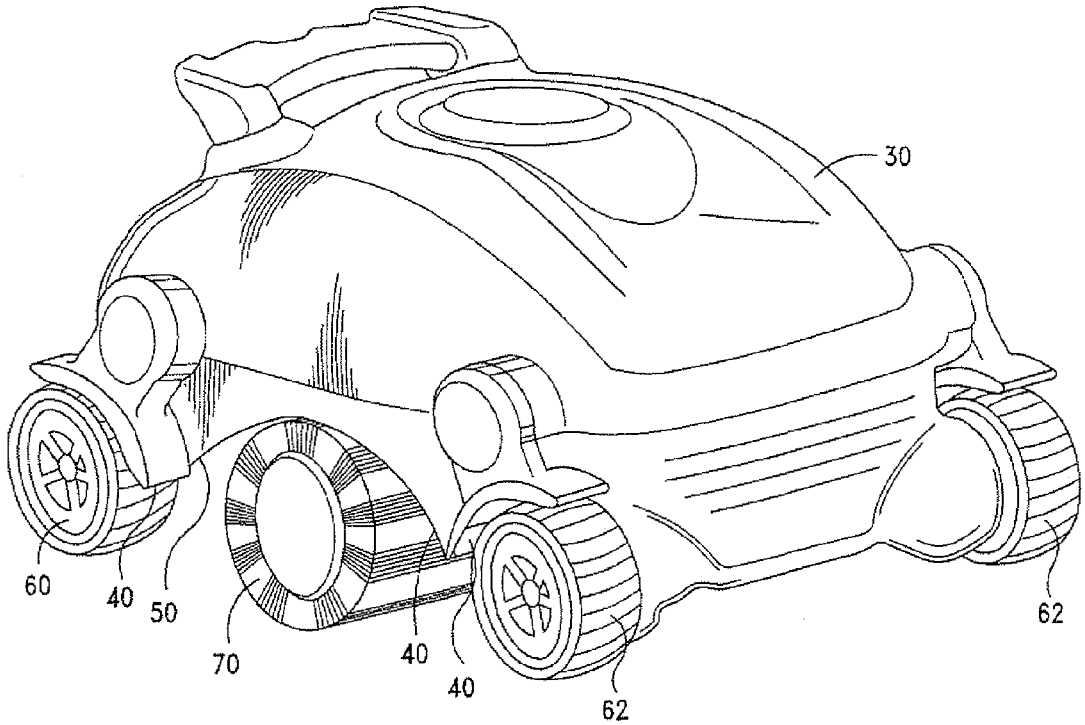

As illustrated in FIGS. 4 & 5, the housing 30 has a curved bottom 50. As illustrated in FIG. 1, the curved bottom 50 assists the PCV 20 in climbing steps in the pool and handing other irregular surfaces in the pool.

In addition to the curved bottom 50, other specialized structures include the PCV 20 having a first pair of wheels 60, a second pair of wheels 62 and a middle roller 70. It will be appreciated by those skilled in the art that the first and/or second pairs of wheels, 60 and 62 respectively, are capable of being rollers and not merely pair of wheels. Additionally each of these rollers or wheels are capable of being drive wheels in various other embodiments within the spirit and scope of the invention.

As shown in FIGS. 4 & 5, the middle roller 70 comprises a single roller. As illustrated and described below, the middle roller is not limited to defining a single roller. Embodiments employing more than one roller are likewise within the spirit and scope of the invention. Additionally, and as applies to all the embodiments shown and described herein, the rollers are equally capable of being drive rollers or not. This, too, does not depart from the spirit and scope of the invention.

Additionally, the middle roller 70 shown in FIGS. 4 & 5 is shown as having a diameter as slightly larger than the diameter of the first and second pairs of wheels, 60 and 62, respectively. This is contrasted with the exemplary embodiment shown in FIG. 3, which features a middle roller 72, which has a diameter, approximately the same size as the first and second pairs of wheels 63 and 65, respectively.

Figure 3:
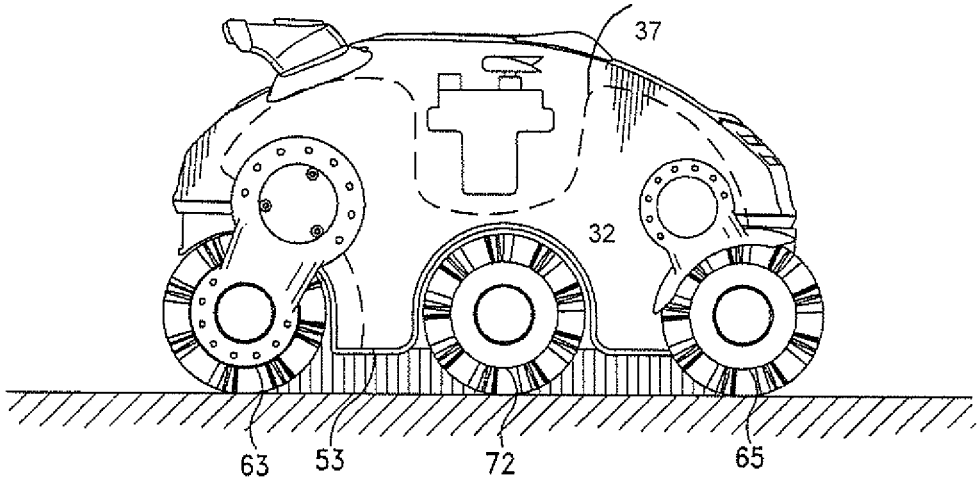
FIG. 3 illustrates a first exemplary embodiment of the PCV in accordance with this invention.

As shown in the embodiment in FIG. 3, the PCV in accordance with this invention also includes a housing having a straight bottom, such bottom 53. Also, as shown in FIG. 3, the filter bag 37 fits within the interior space defining the central opening 32 of the PCV in accordance with this invention.

Figure 6:
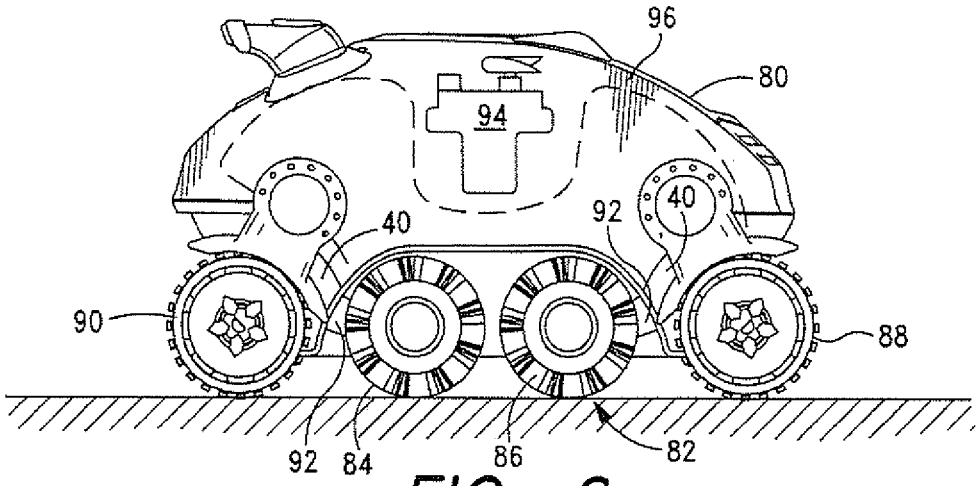
FIGS. 6, 7 & 8 illustrate other exemplary embodiments of the PCV in accordance with this invention, showing the middle roller having various diameter dimensions.
Figure 7:
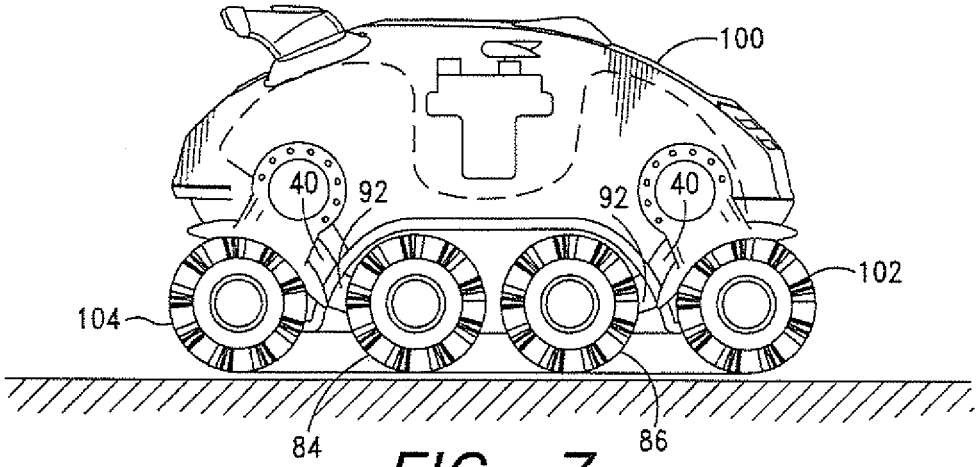
Figure 8:
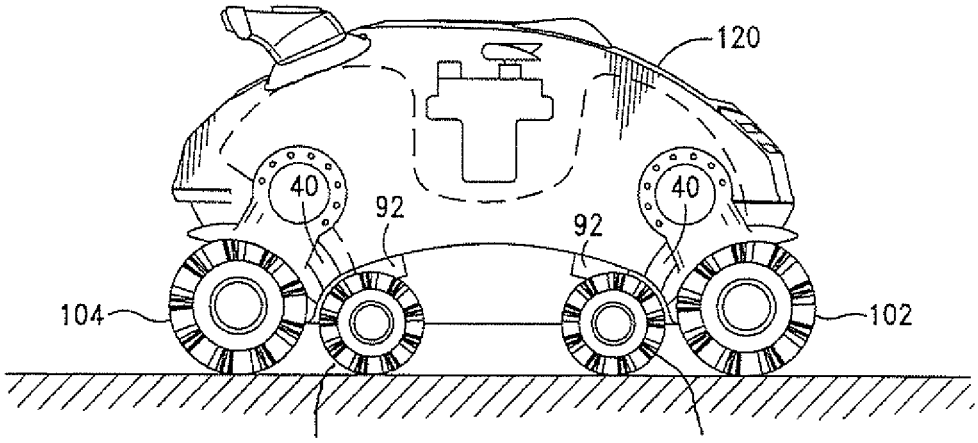

FIGS. 6-8 illustrate other exemplary embodiments of the PCV having a middle roller. With respect to the exemplary embodiment shown in FIG. 6, the housing 80 includes a middle roller member generally indicated by the numeral 82. The roller member 82 includes a pair of rollers 84 and 86. Each of the rollers are the same size and mounted side-by-side to the housing 80 between the first and second pairs of wheels 88 and 90.

Additionally, the middle rollers 84 and 86 are approximately the same size diameter as the first and second pairs of wheels 88 and 90, respectively.

Each of the wheels and rollers includes intakes 92 and 40 associated with each such roller or pair of wheels. Each of the intakes 92 and 40 is connected to the vacuum pump 94 and a filter bag 96. Not only do the middle rollers 84 and 86 assist in overcoming and negotiating irregular objects and structures in the pool, but the additional intakes also provide for thorough and complete cleaning the pool surfaces.

With respect to FIG. 7, there is shown another exemplary embodiment having a housing 100. This embodiment is similar in most respects to the earlier described embodiment shown in FIG. 6 with the exception that the first and second pair of wheels 88 and 90, respectively, are replaced by first and second rollers, 102 and 104, respectively. These rollers 102 and 104 act as cleaning brushes in much the same way as the earlier described rollers operate.

These rollers stir up the dirt and encourage dirt and debris into the intakes 92 and 40.

With respect to FIG. 8, there is shown another exemplary embodiment having a housing 120. This embodiment is similar in most respects to the earlier described embodiment shown in FIG. 7 with the exception that middle rollers, 122 and 124, replace the middle rollers 84 and 86 respectively. Each of the middle rollers, 122 and 124 have a diameter smaller than the diameter of the first and second rollers 102 and 104, respectively. In certain applications it is advantageous to have the middle roller comprise a pair of rollers and each of the rollers has a diameter smaller than the first and second rollers 102 and 104. Again, these rollers whether small, larger or the small size can either be drive rollers or not, within the spirit and scope of the invention.

All of the previous exemplary embodiments have been shown and described as having a housing including a pump for creating a vacuum. It will, of course, be appreciated that the specialized structure of the invention is not limited to such housings. In fact, the housing having a bottom which is curved and a middle roller will work equally well with an in-ground pool cleaner, which typically has the vacuum created through the pool's cleaning system and the PCV, typically has no on-board pump.

While the foregoing detailed description has described several exemplary embodiments of the PCV in accordance with this invention, it is to be understood that the above description is illustrative only and not limiting of the disclosed invention. Thus, the invention is to be limited only by the claims as set forth below.

What is claimed is:

1. An automated pool cleaning vehicle (PCV) having a middle roller, the PCV having an interior including a pump for creating a vacuum for sucking up dirt and debris, the PCV, comprising:

a housing defining an enclosure having an interior, the housing having a bottom and the bottom being concave;

a first and second pair of wheels connected to the housing and adapted to facilitate vehicle movement;

at least one other pair of wheels defining a middle roller, the middle roller connected to the housing between the first and second pair of wheels;

an intake means associated with each pair of wheels for facilitating the sucking up of dirt and debris into the housing through the vacuum created by the pump.

2. The automated pool cleaning vehicle as set forth in claim 1, wherein the middle roller includes a single pair of wheels, the middle roller wheels having a slightly smaller diameter than the first and second wheels.

3. The automated pool cleaning vehicle as set forth in claim 1, wherein the middle roller includes a single pair of wheels, the middle roller wheels having a slightly larger diameter than the first and second wheels.

4. The automated pool cleaning vehicle as set forth in claim 1, wherein the middle roller includes a single pair of wheels, the middle roller wheels having approximately the same diameter as the first and second wheels.

5. The automated pool cleaning vehicle as set forth in claim 1, wherein the middle roller includes two pairs of wheels, each of the middle roller wheels having a slightly smaller diameter than the first and second wheels.

6. The automated pool cleaning vehicle as set forth in claim 1, wherein the middle roller includes two pairs of wheels, each of the middle roller wheels having a slightly larger diameter than the first and second wheels.

7. The automated pool cleaning vehicle as set forth in claim 1, wherein the middle roller includes two pairs of wheels, each of the middle roller wheels having approximately the same diameter as the first and second wheels.

8. The automated pool cleaning vehicle as set forth in claim 1, wherein the middle roller includes more than a pair of wheels.

9. The automated pool cleaning vehicle as set forth in claim 1, wherein the middle roller defines a drive roller.

10. An automated pool cleaning vehicle (PCV) having a middle roller, the PCV utilizing the pool's cleaning system to create a vacuum for sucking up dirt and debris, the PCV, comprising:

a housing defining an enclosure having an interior, the housing having a bottom and the bottom being concave;

a first and second pair of wheels connected to the housing and adapted to facilitate vehicle movement;

at least one other pair of wheels defining a middle roller, the middle roller connected to the housing between the first and second pair of wheels;

an intake means associated with each pair of wheels for facilitating the sucking up of dirt and debris into the housing through the vacuum created by the pool system.

* * * * *